United States Patent [19]

Miller et al.

[11] 4,359,114

[45] Nov. 16, 1982

[54] RAISE DRILL BIT INBOARD CUTTER ASSEMBLY

[75] Inventors: James D. Miller; Worm Lund, both of Bellevue; Donald W. Jones, Seattle, all of Wash.

[73] Assignee: Robbins Machine, Inc., Seattle, Wash.

[21] Appl. No.: 215,019

[22] Filed: Dec. 10, 1980

[51] Int. Cl.[3] ..... E21B 10/20

[52] U.S. Cl. ..... 175/344; 175/53; 175/365; 175/366

[58] Field of Search ..... 175/53, 344, 360–370, 175/376; 308/8.2; 299/86

[56] References Cited

U.S. PATENT DOCUMENTS

| | | | |
|---|---|---|---|
| 1,636,665 | 7/1927 | Reed | 175/367 X |
| 2,065,743 | 12/1936 | Reed | 175/366 |
| 2,166,664 | 7/1939 | Mead | 175/376 X |
| 3,675,729 | 7/1972 | Neilson | 175/228 |
| 3,917,009 | 11/1975 | Dyer et al. | 175/53 |
| 4,004,644 | 1/1977 | Liljekvist | 175/364 |
| 4,010,808 | 3/1977 | Youngblood | 175/334 |
| 4,042,047 | 8/1977 | Dively et al. | 175/340 |
| 4,108,259 | 8/1978 | Dixon et al. | 175/344 |
| 4,177,866 | 12/1979 | Mitchell | 175/53 |

*Primary Examiner*—Ernest R. Purser
*Attorney, Agent, or Firm*—Graybeal & Uhlir

[57] ABSTRACT

A raise bit (10) is constructed with a plurality of housings (30) secured to cutter carrier frame (14) and disposed about drive stem (12). Housings (30) include a rectangularly-shaped mounting box (48) for rotatably supporting an outboard roller cutter (28). Each housing (30) also includes an upright wall (34) having an upwardly tapered lug (40) extending along the upper edge portion thereof for seating within a correspondingly shaped groove (82) formed along the underside of shoulder section (78) of an L-shaped hanger bracket (68). A roller shell (72) is antifrictionally mounted on a spindle (70) extending outwardly from an upright section (76) of hanger bracket (68). Bracket (68) is held in hooked relationship over lug (40) by a pair of capscrews (74) extending downwardly through clearance holes formed in upright section (76) and engaging within a lower portion of upright wall (34).

18 Claims, 4 Drawing Figures

RAISE DRILL BIT INBOARD CUTTER ASSEMBLY

DESCRIPTION

TECHNICAL FIELD

The present invention relates to a rotary drill bit for forming a raise hole about a pilot hole, and more particularly to inboard cutter assemblies used in such a drill bit to disintegrate the portion of the earth formation disposed adjacent to the pilot hole.

BACKGROUND ART

Vertical or angled shafts in mining are commonly produced by drilling a relatively small diameter pilot hole downwardly into the earth with a pilot bit. Once the desired depth of the hole is reached, the pilot bit is removed and replaced by a much larger diameter raise drill bit. The raise drill bit is rotated and simultaneously pulled upwardly along the pilot hole by a drill string extending downwardly through the pilot hole from a drilling rig located at an upper elevation.

Typically, a raise bit includes a cutter carrier frame and a drive stem extending upwardly from the cutter carrier frame for detachable connection with the drill string extending downwardly through the pilot hole. A plurality of roller cutters are mounted on the upper surface of the cutter carrier frame to disintegrate the earth formations surrounding the pilot hole. The roller cutters commonly have peripheral cutting edge portions which protrude into the face of the raise hole to cut concentric kerfs upon rotation of the raise bit. During reaming operations, the drive stem is subjected to a tremendous upward pull and to an extremely high torque load to rotate the raise bit. The rotational movement of the raise bit is typically erratic with the raise bit continuously increasing and slowing down in rotational speed. This erratic movement imposes cyclical torque loads on the drive stem which tends to fatigue the stem. Also, although the drive stem is guided by the pilot hole, the erratic manner in which the rock at the face of the raise hole fractures tends to cause the raise bit to rock or tilt as it advances upwardly, thereby loading the drill stem in bending. Ultimately, the combined effect of all of these high level loads commonly results in the failure of the drive stem.

Accordingly it is important to design the drive stem to carry as large a load as possible. However, the maximum load which a drive stem is capable of carrying is often significantly reduced by modifications made to the stem to accommodate the center or innermost roller cutters which are used to disintegrate the portions of the earth formation immediately surrounding the pilot hole. The innermost cutters must be located close enough to the pilot hole to ensure that all of the rock surrounding the pilot hole is excavated. If the innermost cutters are positioned too far away from the pilot hole, an annular core may be left surrounding the drive stem. To prevent this from occurring, several alternatives have been used to place the central or inboard cutters as close as possible to the drive stem. In U.S. Pat. Nos. 3,675,729 and 4,108,259, a transverse blind bores or holes are formed in the drive stems for receiving the radially inwardly disposed end of a shaft used to rotatably support a center roller cutter. Such blind holes not only reduce the effective cross-sectional area of the drive stem, but also create stress risers in the drive stems, thereby significantly reducing their capacity to carry the tensile, torsional and bending loads imposed thereon during typical raise drilling operations.

Another commonly employed manner of positioning the center cutters as close to the pilot hole as possible is to relieve or notch the drive stem to provide clearance for the adjacent portion of the saddle used to mount the roller cutters on the cutter carrier frame. Examples of raise bits using this particular alternative are disclosed by U.S. Pat. Nos. 3,917,009, 4,010,808, 4,042,047 and 4,177,866. An obvious drawback of the drive stems disclosed in these patents is that the notch or relief reduces the effective cross-sectional area of the drive stem. Moreover, the relief or notch may create a stress riser in the stem.

In U.S. Pat. No. 4,004,644, the radially inwardly directed end portion of the central roller cutter saddles are welded directly to the drive stem. While this particular technique may locate the central cutters fairly close to the pilot hole, the weldment induces significant stress concentrations on the drive stem thereby reducing its load carrying capability.

DISCLOSURE OF INVENTION

The present invention provides a raise bit for enlarging a preformed pilot hole by disintegrating the earth formation surrounding the pilot hole. The bit includes a cutter carrier frame and a drive stem extending upwardly from the frame and into the pilot hole. A plurality of roller cutter housings are disposed about the cutter carrier frames at locations spaced radially outwardly from the drive stem. At least some of these cutter housings include an upright wall extending generally upwardly from the cutter carrier frame and a rectangularly-shaped cutter mounting box portion disposed obliquely to the plane of the upright wall for rotatably supporting a roller cutter. The upper edge portion of the housing upright wall is upwardly tapered to define an elongate, truncated, V-shaped lug. A shallow pocket or depression extends downwardly along the side of the housing upright wall opposite the box section. The housing lug and pocket are adapted to receive portions of a center cutter assembly which is mounted in cantilever fashion on the upright wall to extend in a direction generally toward the drive stem. This enables the center roller cutters to be located very closely adjacent the drive stem without having to alter the drive stem to either support the roller mounting shaft or provide clearance for the cutter assembly mounting bracket. As a consequence, the load carrying capacity of the drive stem is maximized.

Each of the central roller cutter assemblies includes a generally L-shaped hanger bracket having an elongate upright section sized receivable within the housing pocket and a shorter shoulder section extending transversely outwardly from the upper end portion of the bracket upright section. The shoulder section includes portions which define an elongate, downwardly open groove extending parallel to the plane of the upright section for hooking over the lug portion of a cutter housing. A spindle cantilevers outwardly from the mounting bracket upright section in a direction opposite to said shoulder section. A roller in the form of a truncated cone is antifrictionally mounted on the spindle to rotate thereabout.

The central roller cutter assembly is detachably mounted on a cooperating cutter housing by elongate bolts which extend downwardly through clearance holes formed in the upright wall of the hanger bracket.

The bolts engage within threaded blind holes provided in the portion of the housing upright walls disposed below the hanger bracket. Engagement of the bolts with the housing forces the bracket groove downwardly against the housing lug while simultaneously causing the bracket to rotate about the lug to press the lower edge portion of the bracket against the corresponding face of the housing upright wall. It will be appreciated that, by this construction, only two bolts are needed to mount the central roller cutters on cooperating cutter housings securely enough to withstand the high loads imposed on the cutters during normal operation of the raise bit. Moreover, compactly cantilevering the central cutter assemblies from cooperating housings enables larger diameter roller cutters to be mounted on a given size raise bit than would be possible if the same number of conventional central roller cutters were mounted on the cutter carrier frame in other manners.

The above-described construction of the central roller cutter assemblies and the cooperating roller cutter housings enables the central roller cutter assemblies to be conveniently removed from and assembled on the cutter carrier frame without requiring disassembly of the drive stem from the cutter carrier frame. As a consequence, the time required to replace the central roller cutters, for instance when worn, is kept to a minimum.

Also, the removability of the center roller cutter assemblies provides access to the hardware used to attach the drive stem to the cutter carrier frame, which hardware is located at the upper side of the cutter carrier frame below the central roller cutters. As a consequence, it is possible to conveniently install and remove the drive stem from the top side of the cutter carrier frame.

BRIEF DESCRIPTION OF THE DRAWINGS

The details of a typical embodiment of our invention will be described in connection with the accompanying drawings, in which.

BEST MODE OF THE INVENTION

Figure 1:
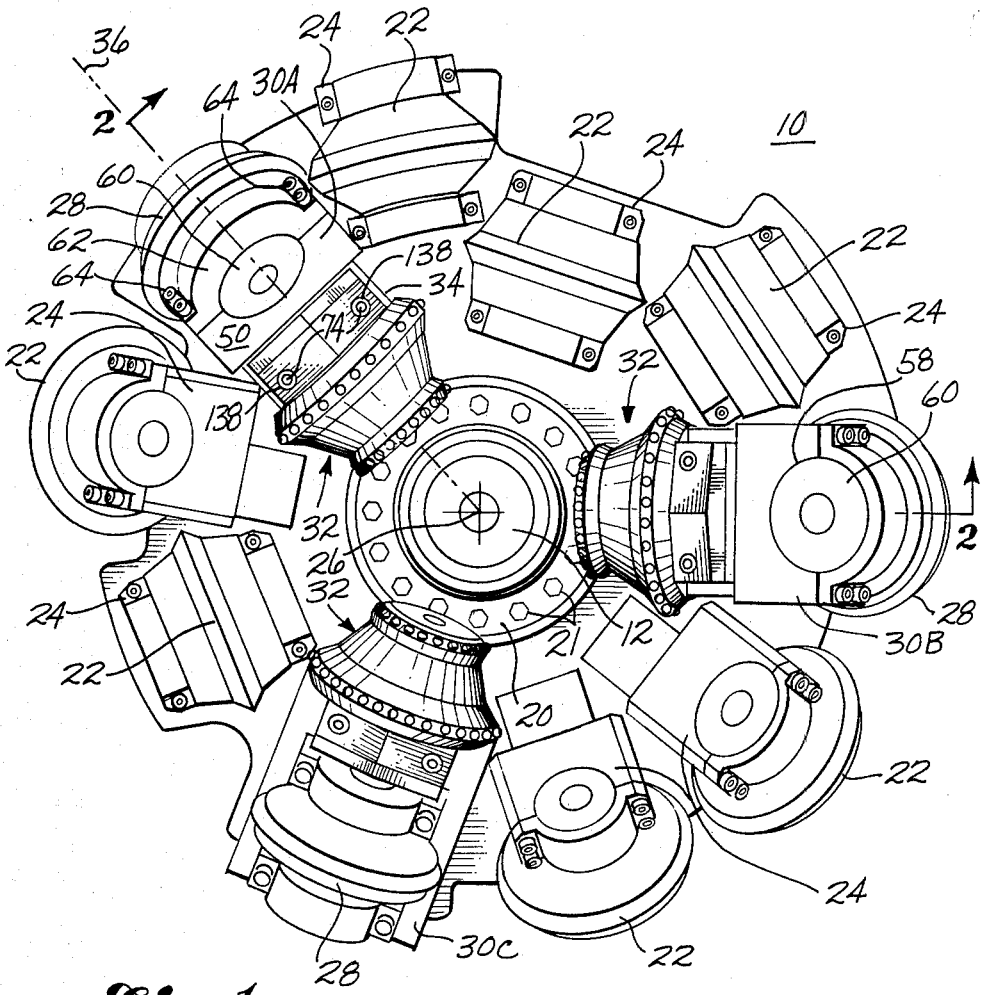
FIG. 1 is a plan view of a raise drill bit embodying the present invention.
Figure 2:
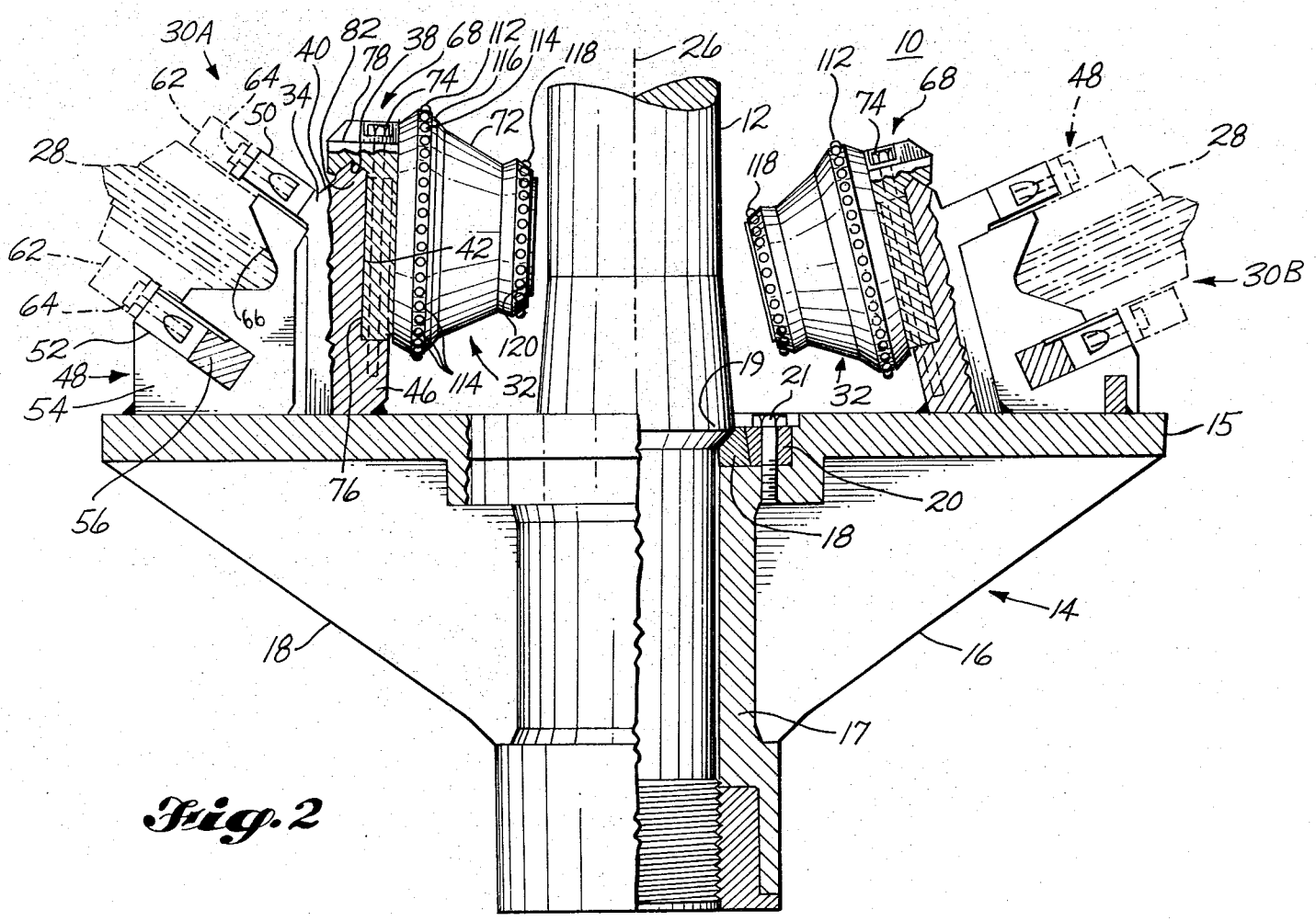
FIG. 2 is a fragmentary, partial cross-sectional view of the embodiment of the invention illustrated in FIG. 1, taken substantially along lines 2—2 thereof.

Referring initially to FIGS. 1 and 2, a raise bit 10, constructed according to the best mode of the present invention, includes a drive stem 12 extending upwardly from a cutter carrier frame 14. Cutter carrier frame 14 includes a generally flat top plate 15 and underlying triangularly-shaped gusset plates 16 which extend outwardly from a central hub 17 which is detachably connectible to stem 12. The lower interior portion of hub 17 is threaded to engage with the corresponding threaded lower end portion of stem 12. Stem 12 is fixed to the upper portion of hub 17 by a split ring 18 which is loaded radially inwardly against a downwardly tapered shoulder 19 formed in stem 17 by a wedge ring 20. Wedge ring 20 has a downwardly and radially outwardly sloped inner diameter edge which presses against the correspondingly sloped outer diameter edge of split ring 18 as the wedge ring is forced downwardly by capscrews 21 which extend through clearance holes formed in the wedge ring to engage with threaded through holes formed in hub 17. It will be appreciated that by this construction, stem 12 can be installed and removed from the top side of cutter carrier frame 14.

As shown in FIG. 1, a plurality of disk cutters 22 are rotatably mounted on corresponding saddles 24 disposed about cutter carrier frame 14 in radial alignment with the rotational center 26 of stem 12.

Figure 4:
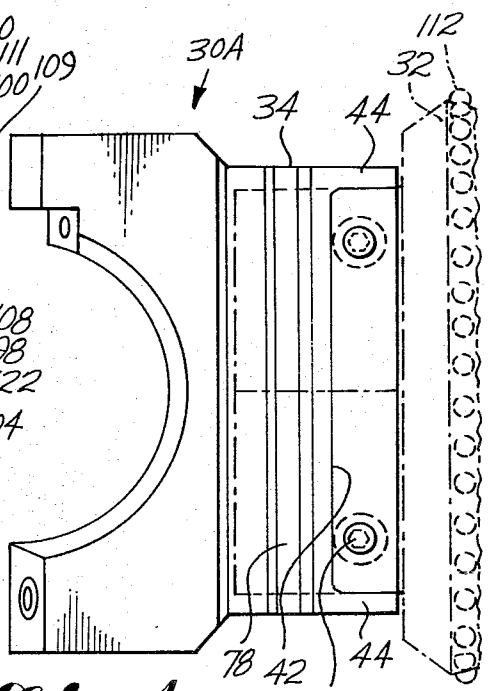
FIG. 4 is a fragmentary view of the portion of the present invention illustrated in FIG. 3, taken substantially along lines 4—4 thereof.

Raise bit 10 as illustrated also includes three roller cutters 28 mounted in respective housings 30A, 30B and 30C, each of which housings is designed also to support a center cutter assembly 32 in cantilever fashion to thereby locate the center cutters closely adjacent to and generally equally spaced around drive stem 12. Although housings 30A, 30B and 30C are slightly different in shape to accommodate the radial location of its corresponding roller cutter 28, the housings each include the same basic components, and thus only housing 30A is specifically described, which description is also applicable to housings 30B and 30C. Housing 30A, which is secured to top plate 15 preferably by weldment, includes a rather thick, generally rectangularly-shaped upright wall 34 extending generally upwardly from the top plate. Ideally, the plane defined by upright wall 34 is disposed transversely to a radial line aligned with the rotational axis of roller cutter 28 and extending through rotational center 26 of bit 10, FIG. 1. A straight, elongate, generally V-shaped ridge or lug 40 extends upwardly from the upper portion of wall 34. Lug 40 is upwardly tapered to terminate at a flat upper surface 38. In cross section, lug 30 is illustrated as composing approximately the central one-third of the total thickness of wall 34. A generally rectangularly-shaped depression or pocket 42 is formed in the side of wall 34 facing stem 12. Pocket 42 extends downwardly from upper edge portion 38 to terminate at an elevation above top plate 15 to thereby define a shoulder or shelf 46 extending below the pocket. Pocket 42 also extends substantially across the entire width of upright wall 34 to define rather narrow side edge portions 44 outwardly of the pocket, FIG. 4.

Figure 3:
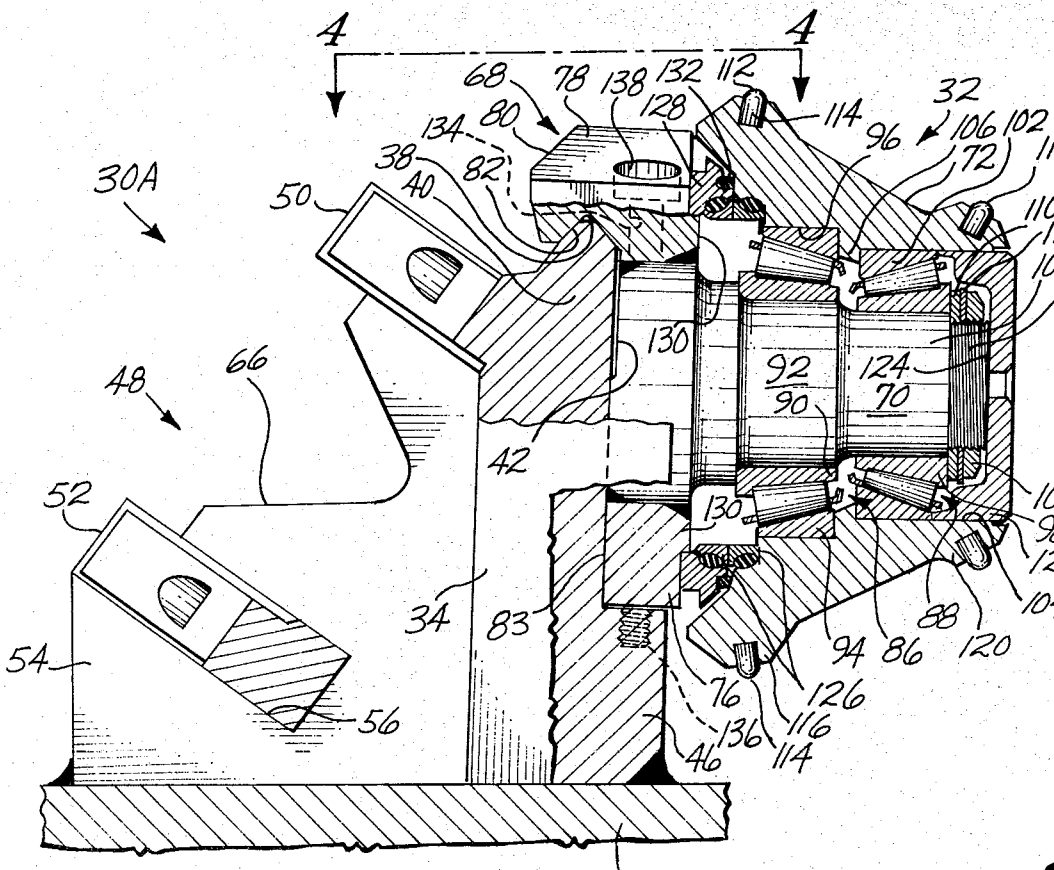
FIG. 3 is an enlarged, fragmentary, side elevational view of the embodiment of the present invention illustrated in FIGS. 1 and 2, specifically illustrating the construction of a cutter housing and a central cutter assembly mounted thereon, with portions broken away for clarity.

Housing 30A also includes a generally square-shaped cutter mounting box 48 disposed obliquely to the plane defined by upright wall 34 for supporting a corresponding roller cutter 28. Box 48 includes an upper retaining wall 50 extending diagonally upwardly and outwardly from the side of the upper edge portion of upright wall 34 opposite to pocket 42. Each side edge of upper wall 50 extends slightly beyond the width of upright wall 34, FIG. 4. A second or lower retaining wall 52 is disposed in spaced parallel relationship to and at an elevation below upper retaining wall 50. Lower retaining wall 52 is supported in this location by a pair of side walls 54 which extend generally transversely outwardly from vertical wall 34 to interconnect the side edge portions of retaining walls 50 and 52. As best shown in FIGS. 2 and 3, each retaining wall 52 includes a rectangularly shaped notched portion 56 for receiving a side edge portion of lower retaining wall 52.

Side walls 54 cooperate with retaining walls 50 and 52 to define a rectangularly-shaped mounting box 48 for supporting a roller cutter 28. To this end, retaining walls 50 and 52 include aligned arcuate recesses 58 for receiving the lower half of one end of a roller cutter mounting shaft 60. The ends of shaft 60 are retained in recesses 58 by capscrews 65 extending through clearance holes provided in the ends of the shaft to engage within threaded holes formed in the retaining walls. As most clearly illustrated in FIGS. 2 and 3, a V-shaped notch 66 is formed in the portion of each side wall 54 extending between retaining walls 50 and 52 to thereby provide clearance for the cutting disc portion of roller cutter 28.

In addition to supporting a roller cutter 28, each housing 30 is designed also to support in cantilevered fashion a central cutter assembly 32 at a location closely adjacent drive stem 12. In basic form, each central cutter assembly 32 includes a generally L-shaped hanger bracket 68 which hooks over lug 40 of upright wall 34. A spindle 70 cantilevers outwardly from bracket 68 to antifrictionally support roller shell 72 for rotation about the spindle. A pair of threaded fasteners, such as capscrews 74 detachably secure center cutter assembly 32 to housing 30A.

Hanger bracket 68 is ideally composed of a generally planar, rectangularly-shaped upright section 76 and a relatively short upper or shoulder section 78 extending transversely from the upper edge portion of the upright section in the direction opposite to the length of spindle 70. The upper surface of shoulder section 78 is crowned along its width to terminate at a central edge which is in alignment with the longitudinal center of spindle 70. A downwardly open, generally V-shaped notch 82 is formed along the underside of shoulder section 78. Notch 82 extends across the width of the shoulder section at a location transversely adjacent but offset from upright section 76. Notch 82 is sized and shaped to closely engage over lug 40 to thereby hook bracket 68 over upper edge portion of upright wall 34. Upright section 76 includes a thrust face 83 which extends outwardly from the lower portion of the side of the bracket upright section opposite to spindle 70 to bear against the adjacent portion of pocket 42.

A spindle 70 extends transversely outwardly from upright section 76 of hanger bracket 68 in radial alignment with bit rotational center 26. Spindle 70 rotatably supports roller 72 through the intermediacy of a pair of spaced apart tapered roller bearings 86 and 88. The inner race 90 of bearing 86, the larger of the two bearings, is engaged over an intermediate diameter portion 92 of spindle 70 while the outer race 94 of the bearing is pressed within a counter-bore 96 formed in the inside diameter of roller shell 72. The inner race 98 of the smaller diameter bearing 88 is engaged over a reduced diameter portion 100 of spindle 70 located outwardly adjacent intermediate diameter portion 92. The outer race 102 of bearing 88 is pressed in a bore 104 formed in the corresponding portion of roller shell 72. Outer race 102 is bottomed against a shoulder 106 formed in the inside diameter of roller shell 72 between counterbore 96 and minor diameter bore 104. Bearings 86 and 88 are preloaded by a lock nut 108 which engages with the threaded free end portion 109 of spindle 70. A lock washer 110 and a tang washer 111 are disposed between nut 108 and bearing inner race 98.

Roller shell 72 is formed generally in the shape of a truncated cone with its major diameter end disposed adjacent the base end portion 84 of the spindle and its minor diameter end disposed adjacent the threaded free end portion 110 of the spindle. A circular row 112 of hard cutter inserts 114 is embedded within a major diameter land 116 extending around the major diameter end of roller shell 72. Cutter inserts 114 are pressed within blind holes extending radially into land 116 to leave a generally semispherical-shaped tip portion extending outwardly of land 116. A row 118 of cutter inserts 114 is also disposed about a minor diameter land 120 formed in the smaller diameter end portion of roller shell 72. It will be appreciated that roller shell 72 can be formed in shapes other than that illustrated in FIGS. 1–4 and with varying numbers of rows of cutter inserts 114 to correspond to the desired cutting profile of raise bit 10 and to the type of rock being drilled.

Bearings 86 and 88 are protected from contamination by a circular cap 122 which is pressed and tack welded within minor diameter bore 104 to thereby close off the smaller diameter end portion of roller shell 72. The inside wall 124 of cap 122 is spaced slightly away from the adjacent end of spindle 70 to avoid any interference therebetween. The opposite end of roller shell 72 is closed off by a pair of face seals 126. One of the seals is seated within a tapered counter-bore formed within roller shell 72 and the other seal is seated within a corresponding tapered counter-bore formed within a retaining ring 128 which is pressed and welded over a thin shoulder 130 formed in the adjacent face portion of hanger bracket upright section 76. Retaining ring 128 also forms a seat for a lip seal 132 which rides against the adjacent end face of roller shell 72. It is to be understood that other types and arrangements of seals can be substituted for face seals 126 and lip seal 130 without departing from the essentially characteristics of the present invention.

Center cutter assemblies 32 are detachably mounted on corresponding housings 30 by a pair of elongate threaded fasteners, such as capscrews 74, which extend downwardly through corresponding clearance bores 134 formed in hanger bracket upright section 76 at each side of spindle 70 and engage within a threaded blind bore 136 formed within shoulder 46 disposed beneath upright section 76. The head of the capscrews are recessed within counterbores 138 formed in the upper surface of bracket shoulder section 78.

As capscrews 74 are engaged with threaded bores 136, groove 82 is forced downwardly to seat against lug 40 which simultaneously causes bracket 68 to pivot about lug 40 to thereby press upright section thrust face 82 against the adjacent portion of housing upright wall 34 to thereby securely attach cutter assembly 32 to the housing through the use of only two easily accessible capscrews. This particular manner of mounting cutter assembly 32 on housing 30 enables the cutter assembly to be conveniently installed on and removed from housing 30 without having to disassemble drive stem 12 from cutter carrier 14. To install cutter assembly 32, the assembly is simply lowered until bracket 68 hooks over lug 40 and then vertical section 76 is swung into pocket 42 so that capscrews 74 can be threadably engaged within shoulders 46. To remove a center cutter assembly from housing 30, capscrews 74 are first loosened and then hanger bracket 68 is simply pivoted about lug 40 to swing roller shell 72 to horizontal orientation, FIG. 2, so that the cutter assembly can be conveniently lifted vertically upwardly away from housing 30 without interference with drive stem 12. It will be appreciated that the above described construction of center cutter assembly 32 and its associated housings 30 not only enables bit 10 to be constructed with roller cutters of as large a size as possible, but also makes it possible to position center cutter assemblies 32 very close to drive stem 12 and over stem mounting hardware and still conveniently replace them when worn, for example. This construction also allows convenient access to capscrews 21 used to mount stem 12 to cutter carrier frame 14.

As will be apparent to those skilled in the art to which the invention is addressed, the present invention may be embodied in forms and embodiments other than those specifically disclosed above, without departing from the spirit or essential characteristics of the invention. The particular embodiments of the present invention, described above, are therefore to be considered in all respects as illustrative and not restrictive, i.e., the scope of the present invention is as set forth in the appended claims rather than being limited to the examples of the invention as set forth in the foregoing description.

We claim:

1. In a raise bit for enlarging a pilot hole into a larger diameter hole by fracturing the earth formation surrounding the pilot hole, the bit having a drive stem projecting upwardly through the pilot hole and a bit body attached to the lower end portion of the stem, the improvement comprising:

a plurality of cutter mounting housings disposed about the bit body at locations spaced radially outwardly from the drive stem, at least one of said housings having portions defining an upwardly projecting lug;

a center roller cutter assembly mounted in cantilever fashion on a corresponding mounting housing to extend generally radially toward the longitudinal center of the stem, each of said roller cutter assemblies including a hanger bracket having an upright section including a thrust face abuttable against said housing, a shoulder section extending transversely outwardly from said upright section and defining a downwardly open groove for receiving a corresponding housing lug and a spindle cantilevered outwardly from said bracket upright section to extend in a direction toward the stem for supporting a roller cutter closely adjacent but spaced from the stem; and securing means for detachably securing said center roller cutter assembly to a corresponding mounting housing.

2. The improvement according to claim 1, wherein said securing means forces said hanger bracket groove against a corresponding housing lug.

3. The improvement according to claim 1 or 2, wherein said securing means includes a tension member having an enlarged first end portion bearing downwardly on said bracket upright section, an intermediate portion extending through said bracket upright section and a second end portion anchored within said cutter mounting housing.

4. The improvement according to claim 1, wherein said hanger bracket thrust face is spaced below said groove and is disposed in a plane parallel to the height of said bracket upright section.

5. The improvement according to claim 4, wherein:

said hanger bracket upright section is generally planar and includes at least one clearance passageway extending downwardly there through;

said hanger bracket groove is spaced transversely from and extends generally parallel to the plane of said upright section; and said securing means extends downwardly through said mounting bracket clearance passageway to engage with portions of said mounting housing to thereby simultaneously load said groove downwardly against said lug and load said thrust face transversely against said housing.

6. The improvement according to claim 5, wherein:

in cross-sectional profile said lug is tapered in the upward direction; and the cross-sectional profile of said hanger bracket groove matches the profile of said lug to thereby cause said hanger bracket to rock about said lug to automatically press said hanger bracket thrust face against said housing upon securing engagement of said securing means with said mounting housing.

7. A roller cutter comprising:

a hanger bracket including a major section having first and second end portions, and a shoulder section extending transversely from said first end portion of said major section, said shoulder section having portions defining a groove open in the direction toward said second end portion of said bracket major section, said major section having a thrust surface located adjacent said second end portion;

a spindle extending transversely outwardly from said bracket major section in a direction opposite to said shoulder section; and roller means antifrictionally mounted on said spindle to rotate about said spindle.

8. A roller cutter according to claim 7, wherein said groove is disposed laterally offset from said bracket major section.

9. A roller cutter according to claim 7 or 8 wherein said groove is generally V-shaped in cross section.

10. A roller cutter according to claim 9, wherein said thrust face lies in a plane disposed generally parallel to the length of said groove.

11. A roller cutter according to claim 7, wherein said hanger bracket includes at least one clearance passageway extending through said major section from said first to said second end portion of said major section.

12. A roller cutter according to claim 7, wherein said roller means if fomred generally in the shape of a truncated cone with a major diameter end portion disposed adjacent said hanger bracket major section and a minor diameter end portion disposed adjacent the free end portion of said spindle.

13. A cutter housing comprising an upright wall having an elongate upper edge portion and a pocket formed along one side of said upright wall to extend downwardly from said upper edge portion; and a pair of parallel, spaced apart retaining walls projecting outwardly from the side of said upright wall opposite said pocket, said retaining walls disposed obliquely to the plane of said upright wall and having aligned arcuate recesses formed therein.

14. A cutter housing according to claim 13, further comprising side walls extending laterally outwardly from the side of said upright wall opposite said pocket to transversely interconnect the end portions of said retaining walls to form a generally rectangularly-shaped roller mounting box disposed obliquely to the plane of said upright wall.

15. A cutter housing according to claim 13, wherein said upright wall upper edge portion is tapered in the upwardly direction.

16. A raise bit for enlarging a preformed pilot hole into a larger diameter by disintegrating the earth formations surrounding the pilot hole, the bit having a cutter carrier frame and a drive stem extending upwardly from the cutter carrier frame and into the pilot hole, the improvement comprising:

a plurality of cutter housings disposed about the cutter carrier frame at locations spaced radially outwardly from the drive stem, at least some of said housings including an upright wall extending generally upwardly from the cutter carrier frame, said upright wall having an elongate upper edge portion, a first roller cutter retaining wall extending transversely outwardly from an upper portion of said upright wall at an orientation obliquely to the plane of said upright wall, and a second roller cutter retaining wall spaced below and parallel to said first roller cutter retaining wall, said two roller cutter retaining walls having aligned arcuate recesses formed therein;

a central roller cutter assembly mounted on a corresponding cutter housing to extend in a direction generally toward the stem, each of said central roller cutter assemblies including;

a hanger bracket having an upright section including upper and lower end portions, a shoulder section extending transversely outwardly from the upper end portion of said upright section, said shoulder section having portions defining an elongate, downwardly open groove extending parallel to the plane of said upright section for receiving the upper edge portion of said cutter housing upright wall;

a spindle cantilevered outwardly from said hanger bracket upright section in a direction opposite to said shoulder section; and roller means antifrictionally mounted on said spindle to rotate about said spindle; and securing means for detachably securing each of said central roller cutter assemblies to a corresponding cutter housing by simultaneously forcing said hanger bracket groove downwardly against the upper edge portion of a corresponding housing upright wall and loading the lower end portion of said hanger bracket upright section against said housing upright wall.

17. The improvement according to claim 16, wherein:

said hanger bracket upright section includes at least one clearance passageway extending downwardly there through; and said securing means includes a tension member extending downwardly through said bracket clearance passageway to engage with portions of said cutter housing upright wall disposed below said bracket upright section.

18. The improvement according to claim 16 or 17, wherein:

in cross-sectional profile the upper edge portion of said cutter housing upright wall is tapered in the upwardly direction; and the cross-sectional profile of said hanger bracket groove corresponds to the profile of the tapered upper edge portion of said cutter housing upright wall to permit said bracket to swing about said upright wall upper edge portion and simultaneously press the lower end portion of said bracket upright section against said housing upright wall upon securing action by said securing means.

* * * * *